US011078921B2

(12) United States Patent
Cao et al.

(10) Patent No.: US 11,078,921 B2
(45) Date of Patent: Aug. 3, 2021

(54) BLADE, IMPELLER AND FAN

(71) Applicant: GREE ELECTRIC APPLIANCES, INC. OF ZHUHAI, Guangdong (CN)

(72) Inventors: Feng Cao, Guangdong (CN); Jianhuang Zou, Guangdong (CN); Zhongjie Liu, Guangdong (CN); Binhua Long, Guangdong (CN); Hao Liu, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 125 days.

(21) Appl. No.: 16/471,074

(22) PCT Filed: Sep. 28, 2017

(86) PCT No.: PCT/CN2017/103960
§ 371 (c)(1),
(2) Date: Jun. 19, 2019

(87) PCT Pub. No.: WO2018/126745
PCT Pub. Date: Jul. 12, 2018

(65) Prior Publication Data

US 2020/0018323 A1 Jan. 16, 2020

(30) Foreign Application Priority Data

Jan. 6, 2017 (CN) ..... 201710009207.9

(51) Int. Cl.
*F04D 29/38* (2006.01)

(52) U.S. Cl.
CPC ..... *F04D 29/384* (2013.01); *F05D 2240/304* (2013.01)

(58) Field of Classification Search
None
See application file for complete search history.

(56) References Cited

U.S. PATENT DOCUMENTS 2,774,308 A * 12/1956 Ulander ..... F01D 5/048 416/23
4,789,306 A * 12/1988 Vorus ..... B63H 1/26 416/223 R (Continued)

FOREIGN PATENT DOCUMENTS

CN 101725566 A 6/2010
CN 201739227 U 2/2011

(Continued)

OTHER PUBLICATIONS

International Search Report for International Application No. PCT/CN2017/103960, dated Jan. 5, 2018, 2 pages.

*Primary Examiner* — Michael Lebentritt
(74) *Attorney, Agent, or Firm* — Armstrong Teasdale LLP

(57) ABSTRACT

A blade, an impeller and a fan are provided. A trailing edge (12) of the blade (1) is provided with at least one concave arc segment (15). At least one end point of the at least one concave arc segment (15) is located between a radial outer edge (13) of the blade (1) and a radial inner edge (14) of the blade (1). The blade (1) is provided with at least one ridge structure protruding from a pressure surface (18) of the blade (1) toward a suction surface (17) of the blade (1). The blade is provided with at least one concave arc segment at a trailing edge thereof on the basis of a bionics principle, and is further provided with a ridge structure, thus improving an airflow pattern at the trailing edge of the blade by means of changing a shape of the blade, and reducing noise accordingly.

17 Claims, 7 Drawing Sheets

(56) References Cited

U.S. PATENT DOCUMENTS

| | | | | |
|---|---|---|---|---|
| 4,830,315 | A * | 5/1989 | Presz, Jr. | F01D 5/141 244/200 |
| 9,829,004 | B2 * | 11/2017 | Ikeda | F04D 25/088 |
| 10,563,657 | B2 * | 2/2020 | Kang | F04D 25/06 |
| 2003/0012656 | A1 | 6/2003 | Cho et al. | |
| 2005/0129561 | A1 * | 6/2005 | Heizer | F01C 1/084 418/201.1 |
| 2005/0260074 | A1 * | 11/2005 | Higashimori | F04D 21/00 415/206 |
| 2007/0098556 | A1 * | 5/2007 | Sanagi | F04D 29/282 416/182 |
| 2009/0075550 | A1 * | 3/2009 | Sun | A63J 7/005 446/28 |
| 2010/0266428 | A1 | 10/2010 | Nakagawa et al. | |
| 2013/0004316 | A1 * | 1/2013 | Matwey | F01D 5/048 416/198 A |
| 2014/0112809 | A1 * | 4/2014 | Kim | F04D 19/002 417/423.7 |
| 2015/0226227 | A1 * | 8/2015 | Ikeda | F04D 29/30 416/182 |
| 2018/0023397 | A1 * | 1/2018 | Vandeputte | F01D 9/041 416/228 |
| 2018/0030996 | A1 * | 2/2018 | Schilling | F04D 29/38 |

FOREIGN PATENT DOCUMENTS

| | | | | |
|---|---|---|---|---|
| CN | 105240317 | A | 1/2016 | |
| CN | 106640748 | A | 5/2017 | |
| CN | 206530536 | U | 9/2017 | |
| EP | 2441963 | A1 * | 4/2012 | F04D 29/282 |
| JP | 2000110785 | A | 4/2000 | |
| JP | 2001082383 | A | 3/2001 | |
| JP | 2001153094 | A * | 6/2001 | F04D 29/281 |
| JP | 2007040197 | A | 2/2007 | |
| JP | 2013113130 | A | 6/2013 | |
| JP | 2016056772 | A | 4/2016 | |
| WO | 2009054815 | A1 | 4/2009 | |

* cited by examiner

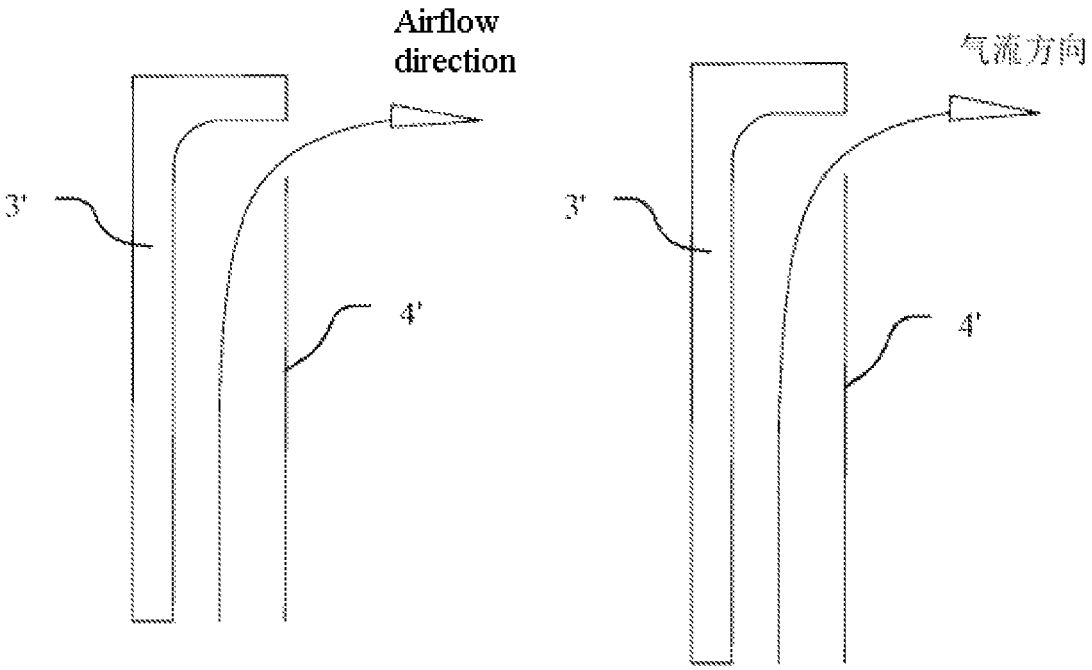
Fig. 7 -- PRIOR ART --
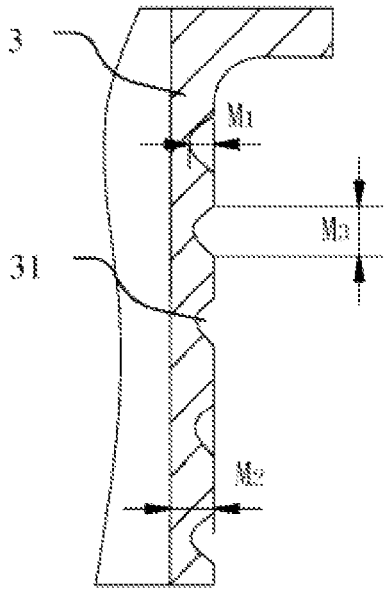
Fig. 8

BLADE, IMPELLER AND FAN

CROSS-REFERENCE TO RELATED APPLICATIONS

This application is the national stage entry of PCT/CN2017/103960, filed on Sep. 28, 2017, which claims the benefit of priority to Chinese Patent Application No. 201710009207.9, filed Jan. 6, 2017, which are incorporated by reference in their entirety herein.

TECHNICAL FIELD

The present disclosure relates to the field of fans, and in particular to a blade, an impeller and a fan.

BACKGROUND

When the speed of a fan is high, especially when the speed is about 3200 Rpm, the boundary layer separation is serious and the airflow turbulence is strong at a trailing edge of a blade when an airflow flows through the surface of the blade, which leads to high broadband noise of the blade, influence on the fan performance, and low use comfort.

SUMMARY

In view of this, some embodiments of the present disclosure is to provide a blade, an impeller and a fan, which can improve the fan performance and reduce the blade broadband noise.

To achieve the above object, according to a first aspect, a blade is provided.

A trailing edge of the blade may be provided with at least one concave arc segment. At least one end point of the at least one concave arc segment may be located between a radial outer edge of the blade and a radial inner edge of the blade. The blade may be provided with at least one ridge structure protruding from a pressure surface of the blade toward a suction surface of the blade.

In an exemplary embodiment, one end of each of the at least one ridge structure is located at an end point of the at least one concave arc segment, and the other end of each of the at least one ridge structure is located at a leading edge of the blade.

In an exemplary embodiment two end points of each of the at least one concave arc segment may be correspondingly provided with two ridge structures.

In an exemplary embodiment, the blade may be provided with multiple ridge structures from the radial inner edge of the blade toward the radial outer edge at intervals, and a maximum height of the ridge structures may gradually decrease from the radial inner edge of the blade toward the radial outer edge.

In an exemplary embodiment the trailing edge of the blade may be provided with a concave arc segment, the at least one ridge structure protruding from the pressure surface of the blade toward the suction surface of the blade may include a first ridge structure close to the radial inner edge of the blade and a second ridge structure close to the radial outer edge of the blade, one end of the first ridge structure is located at an end point of the concave arc segment close to the radial inner edge of the blade, and one end of the second ridge structure is located at an end point of the concave arc segment close to the radial outer edge of the blade.

In an exemplary embodiment, the first ridge structure may have a maximum height W1, the second ridge structure may have a maximum height W2, and in a radial direction, a distance between the radial inner edge of the blade and the radial outer edge may be L.

W1=k1*L, a coefficient k1 ranging from 0.025 to 0.035; and/or,

W2=k2*L, a coefficient k2 ranging from 0.021 to 0.031.

In an exemplary embodiment, each of the at least one ridge structure has a circular arc shape.

In an exemplary embodiment, the trailing edge of the blade may be provided with a concave arc segment, the at least one ridge structure protruding from the pressure surface of the blade toward the suction surface of the blade may include a first ridge structure close to the radial inner edge of the blade and a second ridge structure close to the radial outer edge of the blade, one end of the first ridge structure is located at an end point of the concave arc segment close to the radial inner edge of the blade, one end of the second ridge structure is located at an end point of the concave arc segment close to the radial outer edge of the blade, the first ridge structure may have an arc radius R2 in the circumferential direction, the second ridge structure may have an arc radius R3 in the circumferential direction, and the radial inner edge of the blade may have a radius R1.

R2=k3*R1, a coefficient k3 ranging from 1.3 to 1.4; and/or,

R3=k4*R1, a coefficient k4 ranging from 1.95 to 2.05.

In an exemplary embodiment, a center of each of the at least one ridge structure may coincide with a center of the radial inner edge of the blade.

In an exemplary embodiment, the trailing edge of the blade may be provided with a concave arc segment, and in five elementary stages where the blades are evenly distributed in sequence from the radial inner edge to the radial outer edge, a cascade solidity may be 0.84 to 0.86, 0.77 to 0.79, 0.54 to 0.56, 0.57 to 0.59, and 0.51 to 0.53, and/or, an installation angle may be 30.5 to 32.5, 24.5 to 26.5, 19.5 to 21.5, 15.5 to 17.5, and 13.0 to 15.0, and/or, a front bending angle may be 0°, 1° to 3°, 7° to 9°, 9° to 11°, and 17° to 19°.

In an exemplary embodiment, each of the at least one ridge structure has a sharp-angled structure, and the sharp-angled structure may be connected to the suction surface of the blade and the pressure surface of the blade separately by a smooth curved transition.

According to a second aspect, the present disclosure provides an impeller.

The impeller may include the above-described blade.

In an exemplary embodiment, the impeller may include multiple blades arranged in a circumferential direction, two adjacent blades of the blades may have an angle therebetween, and among angles, at least one angle of the angles may be different from the other angles of the angles in degree.

In an exemplary embodiment, the impeller may include seven blades, and in the circumferential direction, the angles between the adjacent blades may be 49.5° to 50.5°, 51.0° to 52.0°, 45.5° to 46.5°, 58.6° to 59.6°, 47.5° to 48.5°, 46.8° to 47.3°, and 57.5° to 58.5°.

In an exemplary embodiment, the impeller may include a hub and an outer ring, a radial inner edge of the blade may be connected to the hub, a radial outer edge of the blade may be connected to the outer ring, and a radial outer side of the outer ring may be provided with a groove.

In an exemplary embodiment, the radial outer side of the outer ring may be provided with multiple annular grooves, distributed at intervals along an axial direction of the outer ring.

According to a third aspect, the present disclosure provides a fan.

The fan may include the above-described impeller.

According to a fourth aspect, the present disclosure provides a fan.

The fan may include the above-described impeller and a flow guiding ring disposed on a radial outer side of an outer ring of the impeller.

The blade provided by the present disclosure is provided with at least one concave arc segment at a trailing edge thereof on the basis of a bionics principle, and is further provided with a ridge structure, thus improving an airflow pattern at the trailing edge of the blade by means of changing a shape of the blade, and reducing noise accordingly.

BRIEF DESCRIPTION OF THE DRAWINGS

By means of the description for the embodiments of the present invention with reference to the accompanying drawings, the above and other objects, features and advantages of the present invention will become more apparent from:

FIG. 7 schematically shows a structure diagram of a mating part of an outer ring and a flow guiding ring of an existing impeller;

FIG. 8 shows a partial cross-sectional view of an impeller according to a specific embodiment of the present invention;

Figure 1:
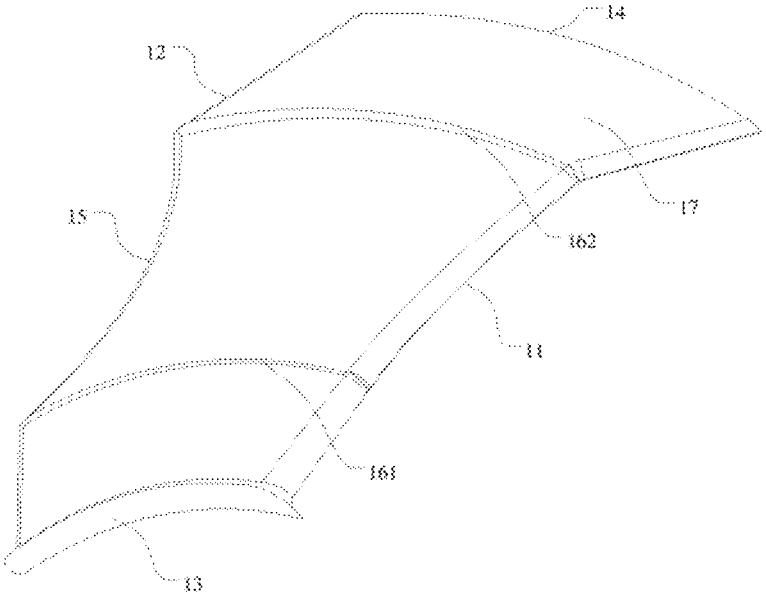
FIG. 1 schematically shows a structure diagram of a blade according to a specific embodiment of the present invention.

In the figures, 1, blade; 11, leading edge; 12, trailing edge; 13, radial inner edge; 14, radial outer edge; 15, concave arc segment; 161, first ridge structure; 162, second ridge structure; 17, suction surface; 18, pressure surface; 2, hub; 3, outer ring; 31, groove; 3', outer ring, 4', flow guiding ring.

DETAILED DESCRIPTION OF THE EMBODIMENTS

The present disclosure is described below based on the embodiments, but the present disclosure is not limited to only these embodiments. In the following detailed description of the present disclosure, some specific details are described in detail. The present disclosure may be fully understood by those skilled in the art without the description of these details. In order to avoid obscuring the essence of the present disclosure, well-known methods, processes, procedures, and components are not described in detail.

In addition, those of ordinary skill in the art should understand that the drawings are provided for the purpose of illustration, and the drawings are not necessarily to scale.

Unless explicitly required by the context, similar words "including", "comprising", and the like in the whole specification and claims should be interpreted as inclusive meanings rather than exclusive or exhaustive meaning, that is, meanings of "including but not limited to".

In the description of the present disclosure, it is to be understood that the terms "first", "second" and the like are used for descriptive purposes only and are not to be construed as indicating or implying relative importance. Further, in the description of the present disclosure, the meaning of "multiple" is two or more unless otherwise specified.

The present disclosure provides a blade. As shown in FIG. 1 to FIG. 4, the blade 1 in the present application is a sheet-like structure, and includes a leading edge 11, a trailing edge 12, a radial inner edge 13 and a radial outer edge 14. The trailing edge 12 of the blade 1 is provided with at least one concave arc segment 15, and at least one end point of the concave arc segment 15 is located between the radial outer edge 14 of the blade 1 and the radial inner edge 13 of the blade 1, that is, at least one end point of the concave arc segment 15 is located between a radial inner side of the radial outer edge 14 of the blade 1 and a radial outer side of the radial inner edge 13. Preferably, two end points of the concave arc segment 15 are both located between the radial outer edge 14 and the radial inner edge 13 of the blade 1. Based on a bionics principle, by changing the shape of the blade 1, the blade is batwing, thus improving an airflow pattern at the trailing edge of the blade, and reducing noise accordingly.

The number of the concave arc segments 15 is not limited and may be determined according to factors such as specific specifications of the blade 1. The specific arc of the concave arc segment 15 is not limited, and may be a circular arc shape or an arc having a constantly changing curvature. Preferably, the curvature of the concave arc segment 15 gradually increases from the radial inner edge 13 of the blade 1 to the radial outer edge 14, and a better airflow pattern can be obtained.

More preferably, the blade 1 has a suction surface 17 and a pressure surface 18. The blade 1 is provided with at least one ridge structure protruding from the pressure surface 18 of the blade 1 toward the suction surface 17 of the blade 1. That is, the pressure surface 18 of the blade 1 is recessed such that both the pressure surface 18 and the suction surface 17 protrude toward the suction surface 17 along the pressure surface 18. Thus, the ridge structure cooperates with the concave arc segment 15 on the trailing edge 12 to further improve the flow pattern of an airflow and reduce the broadband noise of the blade 1. The shape of the ridge structure is not limited in particular. In a preferred embodiment, each of the at least one ridge structure has a sharp-angled structure, and the sharp-angled structure is preferably connected to the suction surface 17 of the blade 1 and the pressure surface 18 via a smooth curved transition. Thus, the occurrence of an airflow dead angle can be avoided, thus improving the performance of a fan using it.

The arrangement of the ridge structure on the blade is not limited. Preferably, one end is located at the leading edge 11 of the blade 1, and the other end of each of the at least one ridge structure is located at the trailing edge 12 of the blade. In order to better cooperate with the concave arc segment 15 on the trailing edge 12 of the blade, more preferably, one end of each of the at least one ridge structure is located at an end point of the at least one concave arc segment 15, and the other end of each of the at least one ridge structure is located at the leading edge 11 of the blade. Thus, the ridge structure and the concave arc segment 15 can form a structure that more closely resembles a batwing, thereby achieving a superior airflow pattern.

In the following, a specific mating structure of the concave arc segment 15 and the ridge structure will be specifically described by taking a concave arc segment 15 at the trailing edge 12 as an example. The concave arc segment 15 is disposed in the middle of the radial direction of the blade 1 (the definition of a specific position can be obtained by defining the ridge structure later). The concave arc segment 15 has two end points, namely a first end point close to the radial inner edge 13 of the blade and a second end point close to the radial outer edge 14 of the blade. The blade 1 is provided with two ridge structures, namely a first ridge structure 161 close to the radial inner edge 13 of the blade and a second ridge structure 162 close to the radial outer edge 14 of the blade. One end of the first ridge structure 161 meets the first end point, and the other end of each of the at least one ridge structure meets the leading edge 11 of the blade. One end of the second ridge structure 162 meets the second end point, and the other end of each of the at least one ridge structure meets the leading edge 11 of the blade. Thus, a shape that more closely resembles a batwing can be formed, thereby improving the airflow at the trailing edge 12 of the blade, and reducing noise generated by the blade.

The ridge structure preferably has a circular arc shape in the circumferential direction, and more preferably, in a plane perpendicular to the axial direction, the circles of the radial inner edge 13 of the blade 1, the radial outer edge 14, the first ridge structure 161 and the ridge structure 162 are concentric.

In order to further optimize the flow pattern of the airflow, the structural parameters of various parts of the blade 1 may be optimized. In a preferred embodiment, a maximum height of the ridge structures is gradually reduced from the radial inner edge of the blade to the radially outer edge. The maximum height of the ridge structures is a vertical distance between a point of a center line of the blade 1 at the top end position of the sharp-angled structure of the ridge structure and a gravity connecting line AB from the radial inner edge 13 of the blade 1 to the radial outer edge 14. In the embodiment shown in FIG. 4, the maximum height of the first ridge structure 161 is W1, the maximum height of the second ridge structure 162 is W2, and W2 is smaller than W1.

Figure 4:
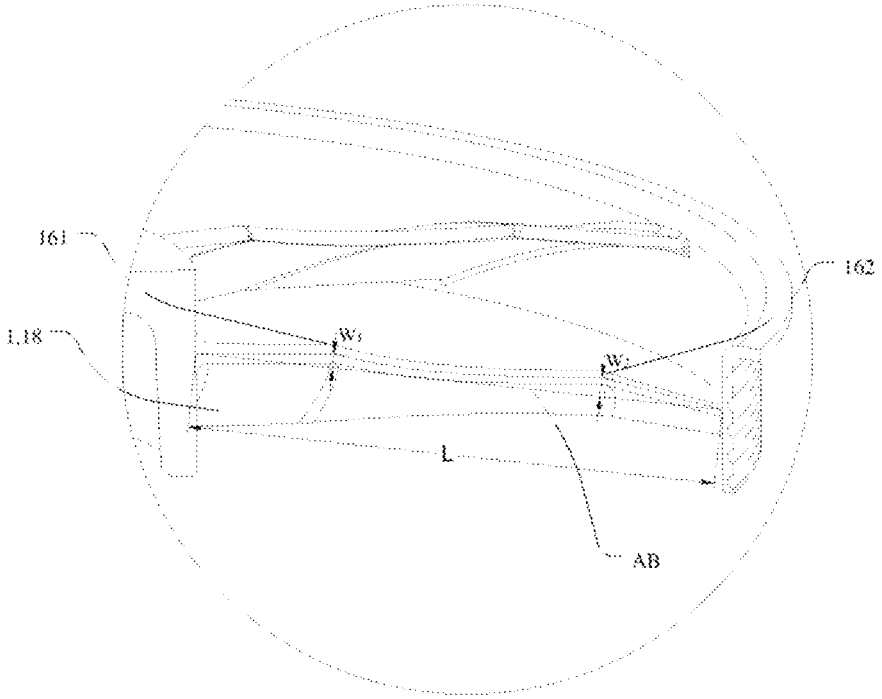
FIG. 4 shows a partial enlarged view of a part A in FIG. 4.

More preferably, as shown in FIG. 4, in a radial direction, a distance between the radial inner edge 13 of the blade 1 and the radial outer edge 14 is L, and the radial direction described herein is not a projection direction in a plane perpendicular to the axial direction. Since the blade 1 has a certain angle with respect to the axial direction after installation, the radial direction here is that a radial line is drawn at the center, the radial line can be intersected with the radial inner edge 13 and the radial outer edge 14, and the distance between the two intersections is the distance L. W1 and L preferably satisfy the relationship: W1=k1*L, a coefficient k1 ranging from 0.025 to 0.035. W2 and L preferably satisfy the relationship: W2=k2*L, a coefficient k2 ranging from 0.021 to 0.031.

Figure 5:
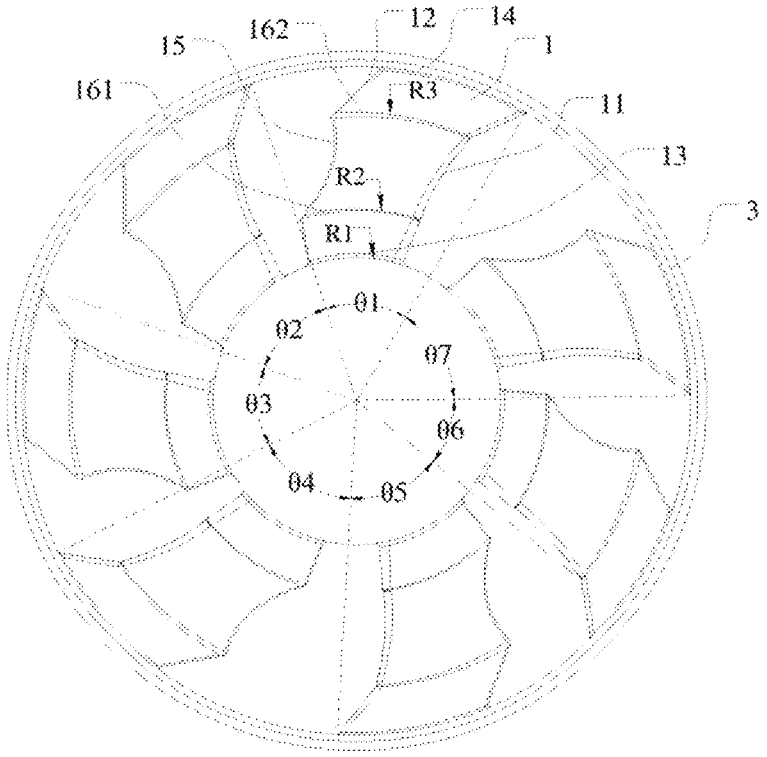
FIG. 5 shows a top view of an impeller according to a specific embodiment of the present invention.
Figure 6:
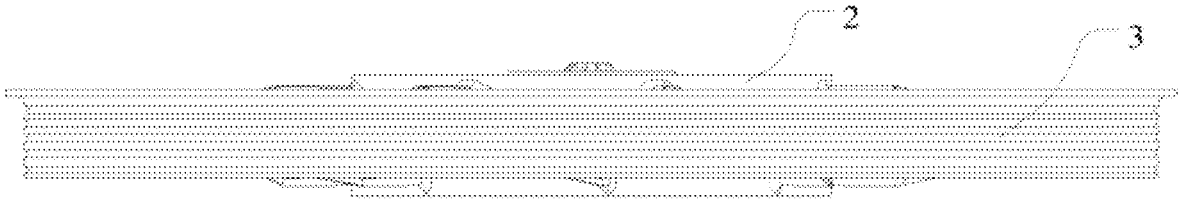
FIG. 6 shows a front view of an impeller according to a specific embodiment of the present invention.

In a preferred embodiment, as shown in FIG. 5, the first ridge structure 161 has an arc radius R2 in the circumferential direction, the second ridge structure 162 has an arc radius R3 in the circumferential direction, and the radial inner edge 13 of the blade 1 has a radius R1. R1 and R2 preferably satisfy the relationship: R2=k3*R1, a coefficient k3 ranging from 1.3 to 1.4. R1 and R3 preferably satisfy the relationship: R3=k4*R1, a coefficient k4 ranging from 1.95 to 2.05.

Figure 2:
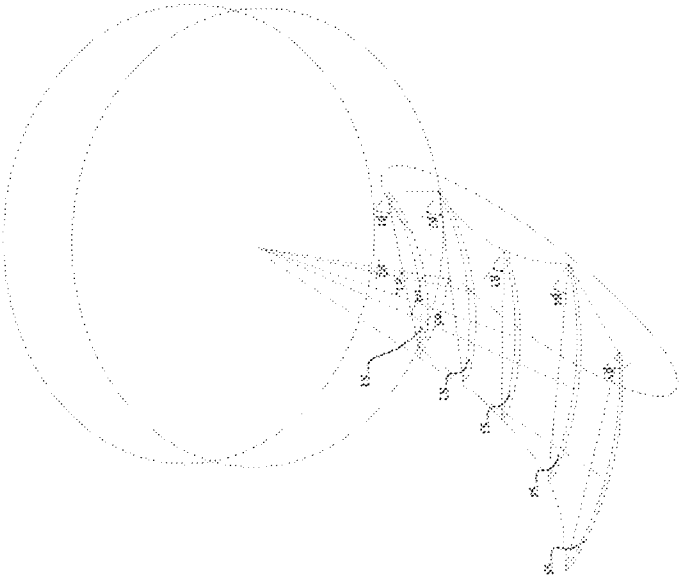
FIG. 2 schematically shows a structure diagram of five elementary stages of a blade according to a specific embodiment of the present invention.
Figure 3:
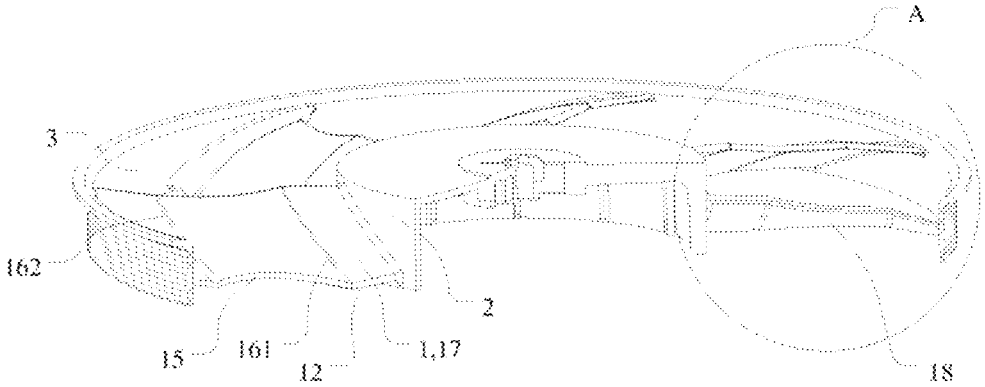
FIG. 3 shows a partial cross-sectional stereogram of an impeller according to a specific embodiment of the present invention.

In a preferred embodiment, as shown in FIG. 2, in five elementary stages (S1, S2, S3, S4, and S5 from the radial inner edge to the radial outer edge) where the blades 1 are evenly distributed in sequence from the radial inner edge 13 to the radial outer edge 14, a cascade solidity is 0.84 to 0.86, 0.77 to 0.79, 0.54 to 0.56, 0.57 to 0.59, and 0.51 to 0.53, an installation angle (β1, β2, β3, β4, and β5 from the radial inner edge to the radial outer edge) is 30.5 to 32.5, 24.5 to 26.5, 19.5 to 21.5, 15.5 to 17.5, and 13.0 to 15.0, and a front bending angle (σ1, σ2, σ3, σ4, and σ5 from the radial inner edge to the radial outer edge) is 0°, 1° to 3°, 7° to 9°, 9° to 11°, and 17° to 19°. The elementary stage is a portion where the circumferential surface of the radius R intersects with the blade 1 in the axial direction, the circumferential surfaces of different radius R can intersect with the blade 1 to form different elementary stages, and the blade is composed of an infinite number of elementary stages. The installation angle is an angle between a blade chord and a direction of rotation. A front bending angle is an angle between connecting lines of the centers of different elementary stages and the center of rotation of the blade. By default, the front bending angle of the first elementary stage is 0°.

Further, the present application also provides an impeller, adopting the above blade. In a specific embodiment, as shown in FIG. 3 to FIG. 6, the impeller includes a hub 2. Radial inner edges 13 of multiple blades 1 are fixed to the peripheral surface of the hub 2 and distributed along a circumferential direction. Preferably, in a plane perpendicular to the axis of the hub 2, the corresponding ridge structures on multiple blades 1 are respectively located on the same circle. For example, as shown in FIG. 5, the first ridge structures 161 of the multiple blades 1 are all located on the same circle, and the second ridge structures 162 of the multiple blades 1 are also located on the same circle.

The blades of the existing impeller are generally arranged evenly in the circumferential direction, and the airflow flowing through the blades and the blades are periodically beaten, thereby generating a dipole noise source, that is, a blade passing noise. This type of noise is a narrow-band noise, the fundamental frequency noise value is the highest, the fundamental frequency increases with the increase of the speed and the number of blades, and the sound quality is extremely unpleasant and unacceptable. In view of this problem, in the present application, at least one of the angles between adjacent blades 1 is different from the other angles of the angles in degree, and the non-equal spacing can control the noise peak to some extent, especially the peak corresponding to the fundamental frequency.

In the present application, the term "angle" is defined as the angle between the radial outer end of the leading edge of the blade and the center line. In a specific embodiment, as shown in FIG. 5, the impeller includes seven blades. In the circumferential direction, the angles between the adjacent blades 1 are θ1, θ2, θ3, θ4, θ5, θ6, and θ7. θ1 ranges from 49.5° to 50.5°, θ2 ranges from 51.0° to 52.0°, θ3 ranges from 45.5° to 46.5°, θ4 ranges from 58.6° to 59.6°, θ5 ranges from 47.5° to 48.5°, θ6 ranges from 46.8° to 47.3°, and θ7 ranges from 57.5° to 58.5°.

In a further embodiment, the impeller further includes an outer ring 3. The radial inner edge 13 of the blade 1 is connected to the hub 2. The radial outer edge 14 is connected to the outer ring 3. When the impeller is installed on the fan, the impeller is disposed in a flow guiding ring, that is, the flow guiding ring covers the outer circumference of the impeller such that the flow guiding ring is located on a radial outer side of the outer ring 3.

In the conventional art, as shown in FIG. 7, in order to prevent dynamic/static interference between an outer ring 3' and a flow guiding ring 4', a safety gap is provided between the outer ring 3' and the flow guiding ring 4'. During the operation of the fan, an airflow inevitably flows through the gap, thereby causing the leakage, and resulting in reducing the fan efficiency. In order to improve this phenomenon, in the present application, as shown in FIG. 8, a groove 31 is provided on the radial outer side of the outer ring 3, so that the cross-sectional area of the outer ring 3 is repeatedly changed, thereby increasing the resistance of a flow path formed between the outer ring 3 and the flow guiding ring. Thus, the safety gap can be ensured while reducing the leakage, thereby improving the fan efficiency.

The size of the groove 31 should not be too large, and should not be too small. If it is too large, the structural strength of the outer ring 3 is affected, and if it is too small, the effect of increasing the resistance is not achieved. In a preferred embodiment, the depth of the groove 31 is M1≤0.5M2, M2 being the thickness of the outer ring. The range of the width of the groove 31 (i.e., the dimension in the axial direction) M3 is M1<M3<2M1.

Figure 9:
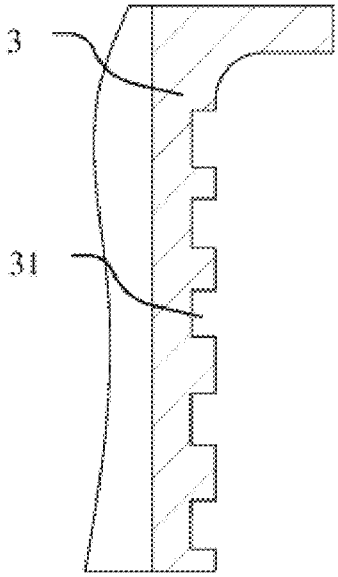
FIG. 9 shows a partial cross-sectional view of another impeller according to a specific embodiment of the present invention.
Figure 10:
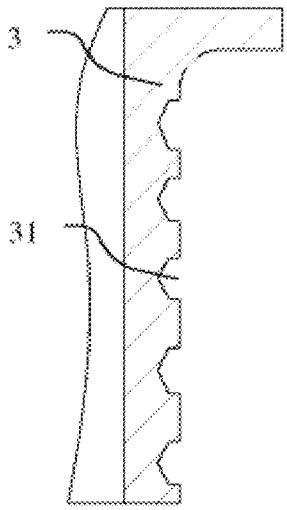
FIG. 10 shows a partial cross-sectional view of yet another impeller according to a specific embodiment of the present invention.
Figure 11:
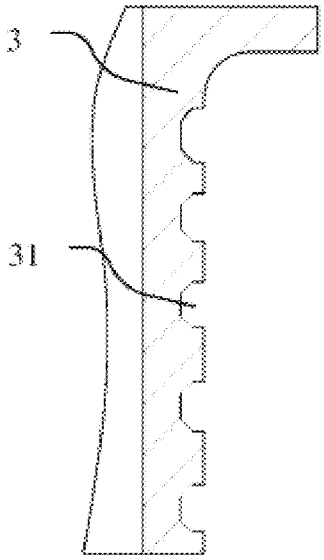
FIG. 11 shows a partial cross-sectional view of a further impeller according to a specific embodiment of the present invention.

The specific shape of the groove 31 is not limited, and is preferably annular, and multiple annular grooves 31 are spaced apart along the axial direction of the outer ring 3, thereby achieving a better effect of increasing the resistance. The cross-sectional shape of the groove 31 is not limited, and may be an arc as shown in FIG. 8, or may be a polygon, for example, a rectangle, a semi-pentagon, a semi-hexagon, etc. as shown in FIG. 9 to FIG. 11. The groove having a polygonal section can further increase the resistance to the airflow and reduce the leakage of the fan.

Further, the present application further provides a fan, which adopts the above-mentioned impeller, can effectively reduce the noise of the fan, and is more reliable in operation, less in leakage and high in efficiency.

Figure 12:
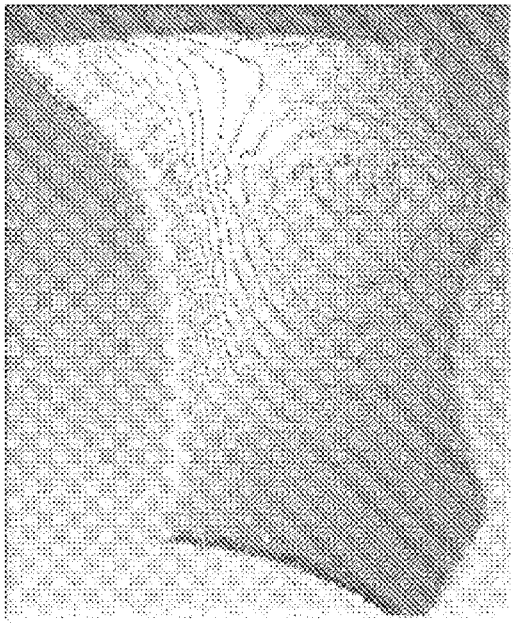
FIG. 12 shows a static pressure distribution view of a blade according to a specific embodiment of the present invention.

In a specific embodiment, the blade specific parameters of the fan are: R2=1.33R1, R3=1.99R1, W1=0.299L, and W2=0.026L, the cascade solidity of S1, S2, S3, S4, and S5 are 0.85, 0.78, 0.55, 0.58, and 0.52, the installation angles are 31.5°, 25.5°, 20.5°, 16.5°, and 14.0°, and the front bending angles are 0°, 2°, 8°, 10°, and 18°. θ1, θ2, θ3, θ4, θ5, θ6, and θ7 are 50°, 51.5°, 46°, 59.1°, 48°, 47.3°, and 58°. The groove depth of the outer ring of the impeller is M1=0.5 M2, M2 is the thickness of the outer ring, the groove width is M3=M1, and the cross-sectional shape of the groove is an arc as shown in FIG. 8. Through simulation experiments, the static pressure distribution of the pressure surface of the blade of the fan is shown in FIG. 12. It can be seen from the figure that through a series of size optimization, the flow pattern of the airflow is further improved, and the broadband noise of the blade is reduced. After specific experimental tests, the results of comparison with existing fans are shown in the following table:

| | Speed n (Rpm) | Static pressure (Pa) | Air volume Q ($m^3$/h) | Fan efficiency η (%) | Noise N (dB/A) |
|---|---|---|---|---|---|
| Existing fan | 3220 | 130 | 2100 | 39.19 | 78.3 |
| Fan of the present application | 3224 | 130 | 2150 | 41.37 | 75.8 |

As can be seen from the above table, the fan of the present application has high efficiency and low noise, the efficiency is 2.18% higher than that of the existing fan, the noise is reduced by 2.5 dB, and the fan has better performance than the existing fan.

The fan provided by the present application can be widely applied to various devices that need to supply air, for example, to air conditioners, especially bus air conditioners.

It will be readily understood by those skilled in the art that the above various preferred solutions can be freely combined and superimposed without conflict.

It will be appreciated that the above embodiments are to be considered as illustrative and not restrictive. Various obvious or equivalent modifications or alterations to the above details will be apparent to those skilled in the art without departing from the basic principle of the present disclosure, which are all included within the scope of the claims of the present disclosure.

What is claimed is:

1. A blade, wherein a trailing edge of the blade is provided with at least one concave arc segment, at least one end point of the at least one concave arc segment is located between a radial outer edge of the blade and a radial inner edge of the blade, and the blade is provided with at least one ridge structure protruding from a pressure surface of the blade toward a suction surface thereof, each of the at least one ridge structure has a circular arc shape in a circumferential direction.

2. The blade as claimed in claim 1, wherein one end of each of the at least one ridge structure is located at an end point of the at least one concave arc segment, and the other end of each of the at least one ridge structure is located at a leading edge of the blade.

3. The blade as claimed in claim 2, wherein two end points of each of the at least one concave arc segment are correspondingly provided with two ridge structures.

4. The blade as claimed in claim 1, wherein the blade is provided with a plurality of ridge structures from the radial inner edge of the blade toward the radial outer edge at intervals, and a maximum height of the ridge structures gradually decreases from the radial inner edge of the blade toward the radial outer edge.

5. The blade as claimed in claim 1, wherein the trailing edge of the blade is provided with a concave arc segment, the at least one ridge structure protruding from the pressure surface of the blade toward the suction surface of the blade comprises a first ridge structure close to the radial inner edge of the blade and a second ridge structure close to the radial outer edge of the blade, one end of the first ridge structure is located at an end point of the concave arc segment close to the radial inner edge of the blade, and one end of the second ridge structure is located at an end point of the concave arc segment close to the radial outer edge of the blade.

6. The blade as claimed in claim 5, wherein the first ridge structure has a maximum height W1, the second ridge structure has a maximum height W2, and in a radial direction, a distance between the radial inner edge of the blade and the radial outer edge is L, where W1=k1*L, a coefficient k1 ranging from 0.025 to 0.035; and/or, W2=k2*L, a coefficient k2 ranging from 0.021 to 0.031.

7. The blade as claimed in claim 1, wherein the trailing edge of the blade is provided with a concave arc segment, the at least one ridge structure protruding from the pressure surface of the blade toward the suction surface of the blade comprises a first ridge structure close to the radial inner edge of the blade and a second ridge structure close to the radial outer edge of the blade, one end of the first ridge structure is located at an end point of the concave arc segment close to the radial inner edge of the blade, one end of the second ridge structure is located at an end point of the concave arc segment close to the radial outer edge of the blade, the first ridge structure has an arc radius R2 in the circumferential direction, the second ridge structure has an arc radius R3 in the circumferential direction, and the radial inner edge of the blade has a radius R1, where R2=k3*R1, a coefficient k3 ranging from 1.3 to 1.4; and/or, R3=k4*R1, a coefficient k4 ranging from 1.95 to 2.05.

8. The blade as claimed in claim 1, wherein a center of each of the at least one ridge structure coincides with a center of the radial inner edge of the blade.

9. The blade as claimed in claim 5, wherein in five elementary stages where the blades are evenly distributed in sequence from the radial inner edge to the radial outer edge, a cascade solidity is 0.84 to 0.86, 0.77 to 0.79, 0.54 to 0.56, 0.57 to 0.59, and 0.51 to 0.53, and/or, an installation angle is 30.5 to 32.5, 24.5 to 26.5, 19.5 to 21.5, 15.5 to 17.5, and 13.0 to 15.0, and/or, a front bending angle is 0° , 1° to 3° , 7° to 9° , 9° to 11° , and 17° to 19° .

10. The blade as claimed in claim 1, wherein each of the at least one ridge structure has a sharp-angled structure, and the sharp-angled structure is connected to the suction surface of the blade and the pressure surface of the blade separately by a smooth curved transition.

11. An impeller, comprising a blade as claimed in claim 1.

12. The impeller as claimed in claim 11, comprising a plurality of blades arranged in a circumferential direction, wherein two adjacent blades of the blades have an angle therebetween, and among angles, at least one angle of the angles is different from the other angles of the angles in degree.

13. The impeller as claimed in claim 12, comprising seven blades, wherein in the circumferential direction, the angles between the adjacent blades are 49.5° to 50.5° , 51.0° to 52.0° , 45.5° to 46.5° , 58.6° to 59.6° , 47.5° to 48.5° , 46.8° to 47.3° , and 57.5° to 58.5° .

14. The impeller as claimed in claim 11, comprising a hub and an outer ring, wherein a radial inner edge of the blade is connected to the hub, a radial outer edge of the blade is connected to the outer ring, and a radial outer side of the outer ring is provided with a groove.

15. The impeller as claimed in claim 14, wherein the radial outer side of the outer ring is provided with a plurality of annular grooves, distributed at intervals along an axial direction of the outer ring.

16. A fan, comprising an impeller as claimed in claim 11.

17. A fan, comprising an impeller as claimed in claim 14 and a flow guiding ring disposed on a radial outer side of an outer ring of the impeller.

* * * * *